US005799578A

United States Patent [19]

Junghans

[11] Patent Number: 5,799,578

[45] Date of Patent: Sep. 1, 1998

[54] PRINTING PRESS AND LIQUID SUPPLY

[75] Inventor: Rudi Junghans, Wilhelmsfeld, Germany

[73] Assignee: Heidelberger Druckmaschinen Aktiengesellschaft, Heidelberg, Germany

[21] Appl. No.: 421,303

[22] Filed: Apr. 13, 1995

[30] Foreign Application Priority Data

Apr. 15, 1994 [DE] Germany ..... 94 06 347.8 U

[51] Int. Cl.[6] ..... B41F 1/46

[52] U.S. Cl. ..... 101/348; 118/685; 118/710; 137/527; 137/527.6

[58] Field of Search ..... 101/348, 349, 101/350, 351, 132.5, 147, 148, 423, 425, 363–367; 118/683, 684, 685, 710, 429; 137/527, 527.6, 527.8, 535, 536, 537

[56] References Cited

U.S. PATENT DOCUMENTS

| | | | |
|---|---|---|---|
| 3,373,052 | 3/1968 | Rode | 101/350 |
| 3,631,800 | 1/1972 | Mignone et al. | 101/350 |
| 4,116,128 | 9/1978 | Lehmann et al. | 101/367 |
| 4,284,005 | 8/1981 | Weigele et al. | 101/363 |
| 4,357,871 | 11/1982 | Köbler et al. | 101/350 |
| 4,527,479 | 7/1985 | Dahlgren et al. | 101/350 |
| 5,036,762 | 8/1991 | Sarda | 101/148 |

FOREIGN PATENT DOCUMENTS

| | | |
|---|---|---|
| 2324462 | 5/1974 | Germany . |
| 2811276 | 9/1979 | Germany . |
| 1406927 | 9/1975 | United Kingdom . |

*Primary Examiner*—Eugene H. Eickholt
*Attorney, Agent, or Firm*—Nils H. Ljungman and Associates

[57] ABSTRACT

A printing press including a device for feeding a viscous fluid, such as a lacquer or varnish. The viscous fluid, such as a lacquer or varnish, can be taken from a cartridge and be distributed to a printed sheet or other suitable medium. In the manner of a pendulum, a pipe can be mounted on a carriage by means of a pivoting bearing. Via a lever, in both pivoting directions, The pivoting bearing can be supported on compression springs and at the upper end of the pipe, there can be disposed a sealing body which corresponds to a sealing surface provided on the carriage. The lower end of the pipe can determine the height of the fluid level in the fluid reservoir so that, with the pipe being in a perpendicular position, the feed opening formed in the carriage coincides with the feed opening of the pipe such that fluid is fed, whereas the feed can be interrupted when the pipe in in an oblique position.

20 Claims, 5 Drawing Sheets

PRINTING PRESS AND LIQUID SUPPLY

BACKGROUND OF THE INVENTION

1. Field of the Invention

The present invention generally relates to a printing press and a device for feeding a viscous fluid, such as a lacquer or varnish, in such a printing press. The viscous fluid, such as a lacquer or varnish, can be taken from a cartridge and be distributed to a printed sheet or other suitable medium.

2. Background Information

Disclosed in German Patent No. 23 24 462 C2 is a device in which separate sensor means are provided to monitor the level of fluid in a fluid reservoir. Electrical control means are provided to feed the fluid over a given period of time.

A device metering and feeding viscous fluid is also shown in German Patent No. 28 11 276 C2, in which a capacitive proximity switch is provided as a distance sensor monitoring the level of fluid in a fluid reservoir. If necessary, a plunger, which may be advanced stepwise, feeds a predetermined quantity of fluid. Here, too, an electrical monitoring device is provided. With the known embodiments the electrical monitoring means may, however, become soiled, thereby causing malfunctions.

OBJECT OF THE INVENTION

Proceeding from the known arrangements discussed above, it is an object of the present invention to ensure efficient storage and distribution of a viscous fluid, such as a lacquer or varnish, in a rotary printing press.

SUMMARY OF THE INVENTION

According to at least one preferred embodiment of the present invention, the above object is achieved in that, like a pendulum, a pipe can be mounted on a carriage by means of a pivoting bearing. Via a lever, in both pivoting directions, The pivoting bearing can be supported on compression springs and at the upper end of the pipe, there can be disposed a sealing body which corresponds to a sealing surface provided on the carriage. The lower and of the pipe can determine the height of the fluid level in the fluid reservoir so that, with the pipe being in a perpendicular position, the feed opening formed in the carriage coincides with the feed opening of the pipe such that fluid is fed, whereas the feed can be interrupted when the pipe is in an oblique position.

Given a low level, the fluid reservoir can be continuously filled with fluid as a result of the reciprocating motion of the carriage with the pipe. If the fluid level reaches a height at which the lower end of the pipe comes into contact with the viscous fluid, the fluid can essentially urge the pipe to leave its perpendicular position due to the motion of the carriage, and the feed can be interrupted as a result of the pivoting motion. Depending on how far the lower end of the pipe roaches into the fluid reservoir, a very small quantity of fluid can be maintained at an essentially constant level. Due to the pressureless feeding and the uniform distribution, it may be ensured that the quantity of fluid that is subsequently conveyed to the printing press, such as to a lacquering or varnishing station, is accurately metered.

The above discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

In summary, one aspect of the invention resides broadly in a device for feeding a fluid to a rotary printing machine, the printing machine comprising a fluid reservoir provided with a metering device, with the fluid being taken from a cartridge and being distributed over the length of the fluid reservoir so that a carriage with the cartridge is reciprocatingly guided at a traverse in longitudinal direction of the fluid reservoir, characterized in that, like a pendulum, a fluid-feeding pipe in mounted on the carriage by means of a pivoting bearing, that in both pivoting directions the pivoting bearing is supported, via a lover, on compression springs, that at the upper end of the fluid-feeding pipe there is provided a sealing body matching a sealing surface provided at the carriage, and that the lower end of the fluid-feeding pipe determines the height of the ink level in the fluid reservoir so that, with the fluid-feeding pipe being in a perpendicular position, the food opening formed in the carriage corresponds to the food opening of the fluid-feeding pipe, and printing ink is supplied; whereas the ink feed is interrupted, with the fluid-feeding pipe being in an oblique position.

BRIEF DESCRIPTION OF THE DRAWINGS

A specimen embodiment of the present invention is schematically illustrated in the drawings, wherein.

DESCRIPTION OF THE PREFERRED EMBODIMENT

Figure 1:
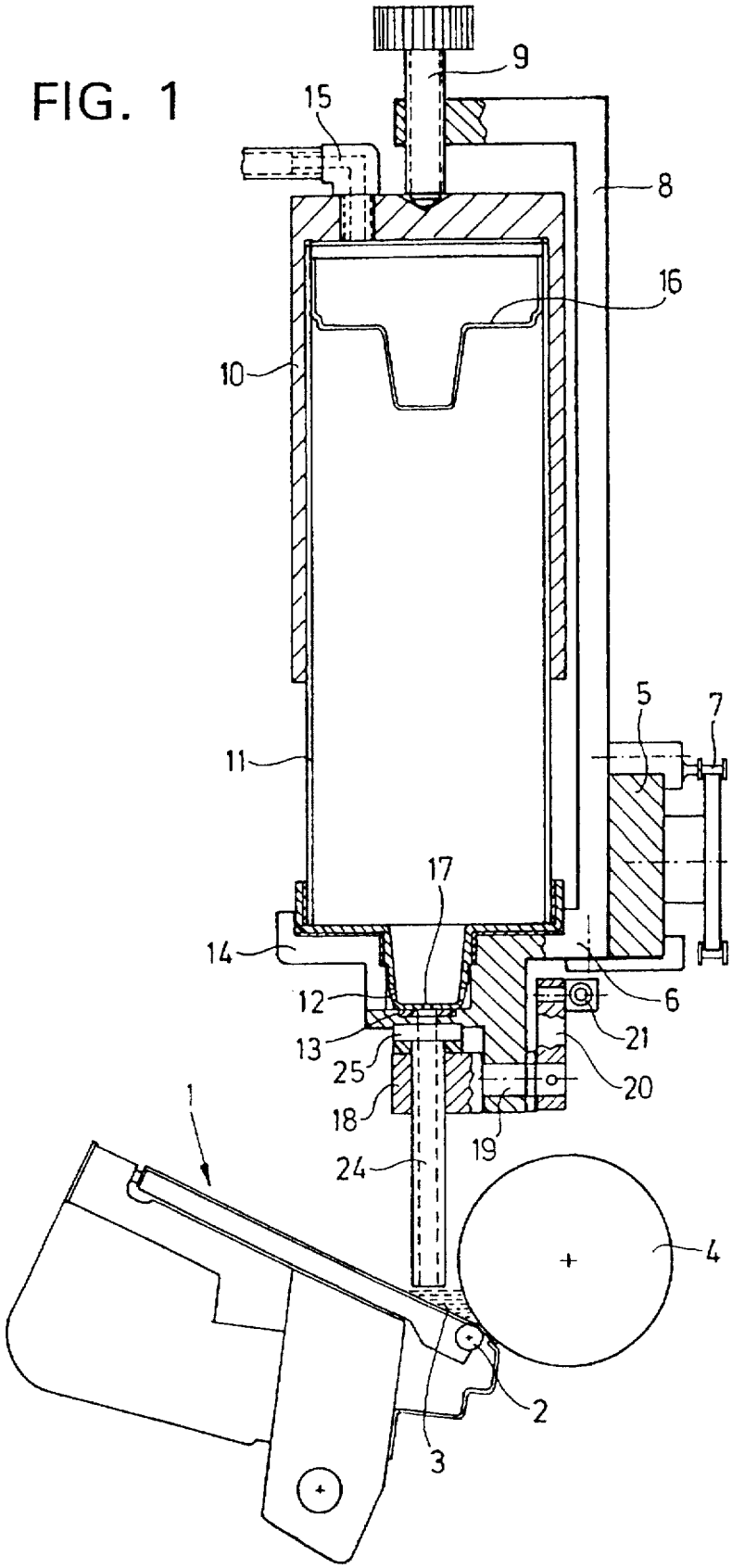
FIG. 1 is a cross-sectional view of the device.
Figure 1A:
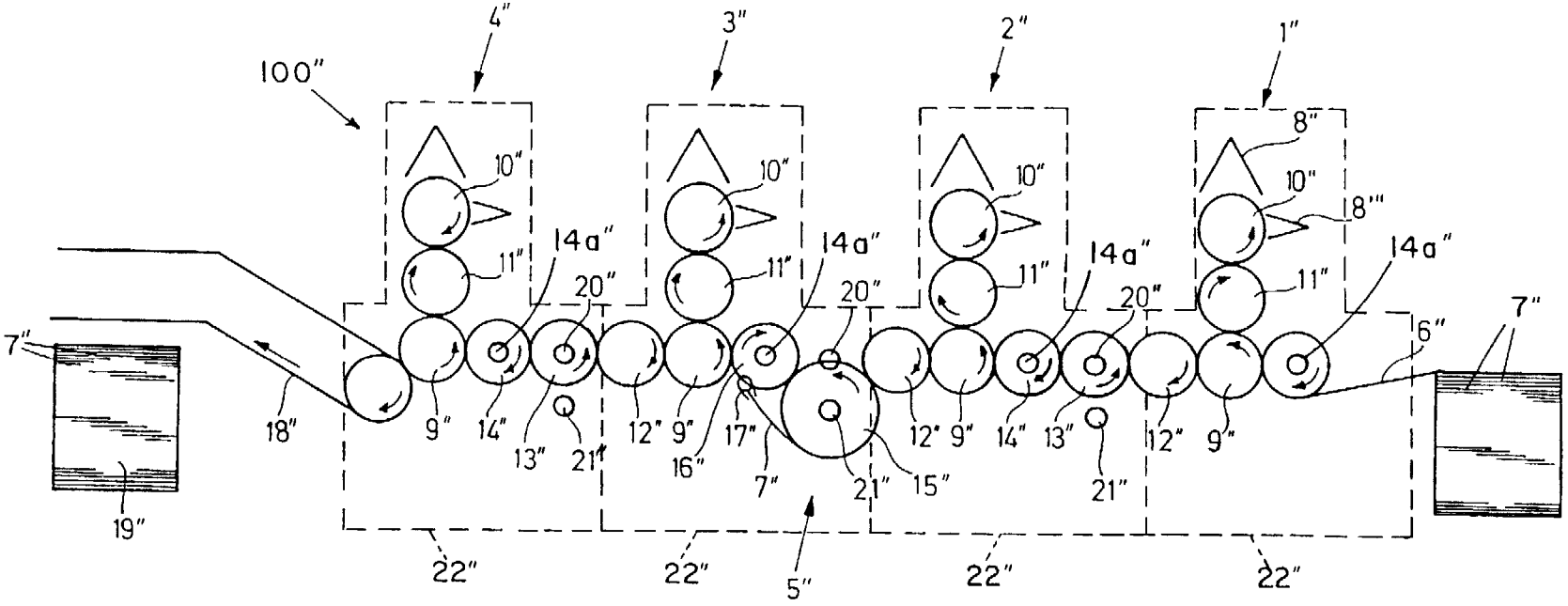
FIG. 1*a* illustrates a multi-unit printing press in which the present invention may be employed.

FIG. 1*a* schematically illustrate a multi-unit printing press 100" in which the present invention may be employed. Particularly, a multi-unit printing press 100" may typically include a plurality of printing units, such as four printing units 1", 2", 3"and 4". Each printing unit may typically include a support frame arrangement 22".

The sheets 7" to be processed can preferably be fed from a supply stock to the impression cylinder 9" of a first printing unit 1" by sheet feeder 6". Bach sheet 7" can preferably receive its first ink application by means of plate cylinder 10" and blanket cylinder 11" of printing unit 1". Accordingly, each subsequent printing unit 2", 3" and 4" can also typically include its own plate cylinder 10" and blanket cylinder 11". Typically, an inking unit 8" and damping unit 8'" can be assigned to each plate cylinder 10".

Other components illustrated in FIG. 1*a* but not otherwise described herein are discussed in U.S. Pat. No. 5,016,529 to Jahn, which is incorporated by reference herein.

It should be understood that the components and method discussed above with relation to FIG. 1*a* may, if appropriate, essentially be considered to be interchangeable with similar components and methods discussed herebelow with relation to FIGS. 1*c*, 1, 1*b*, 2 and 2*a*.

Figure 1B:
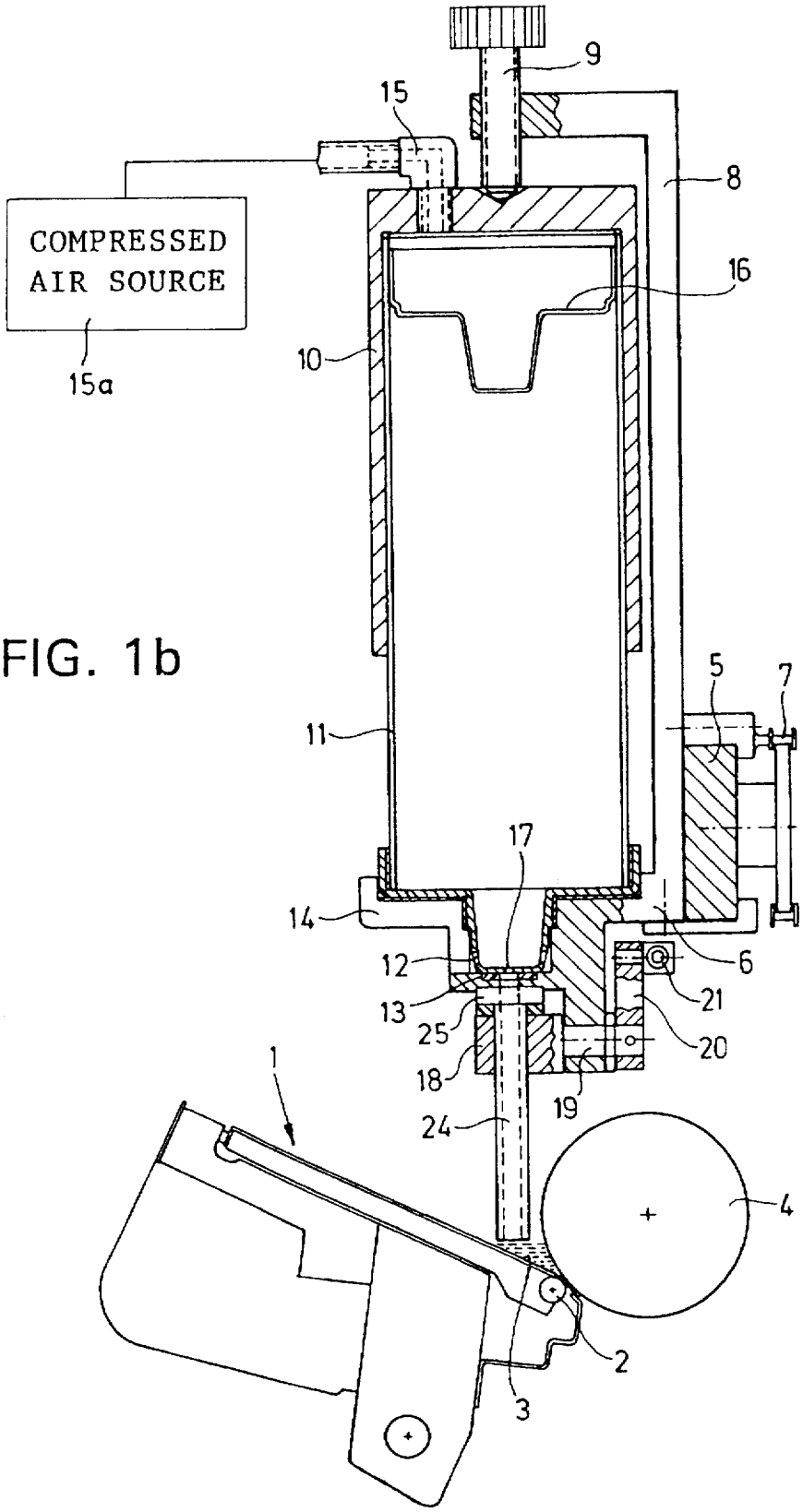
FIG. 1*b* is essentially the same view as FIG. 1, but more detailed.
Figure 1C:
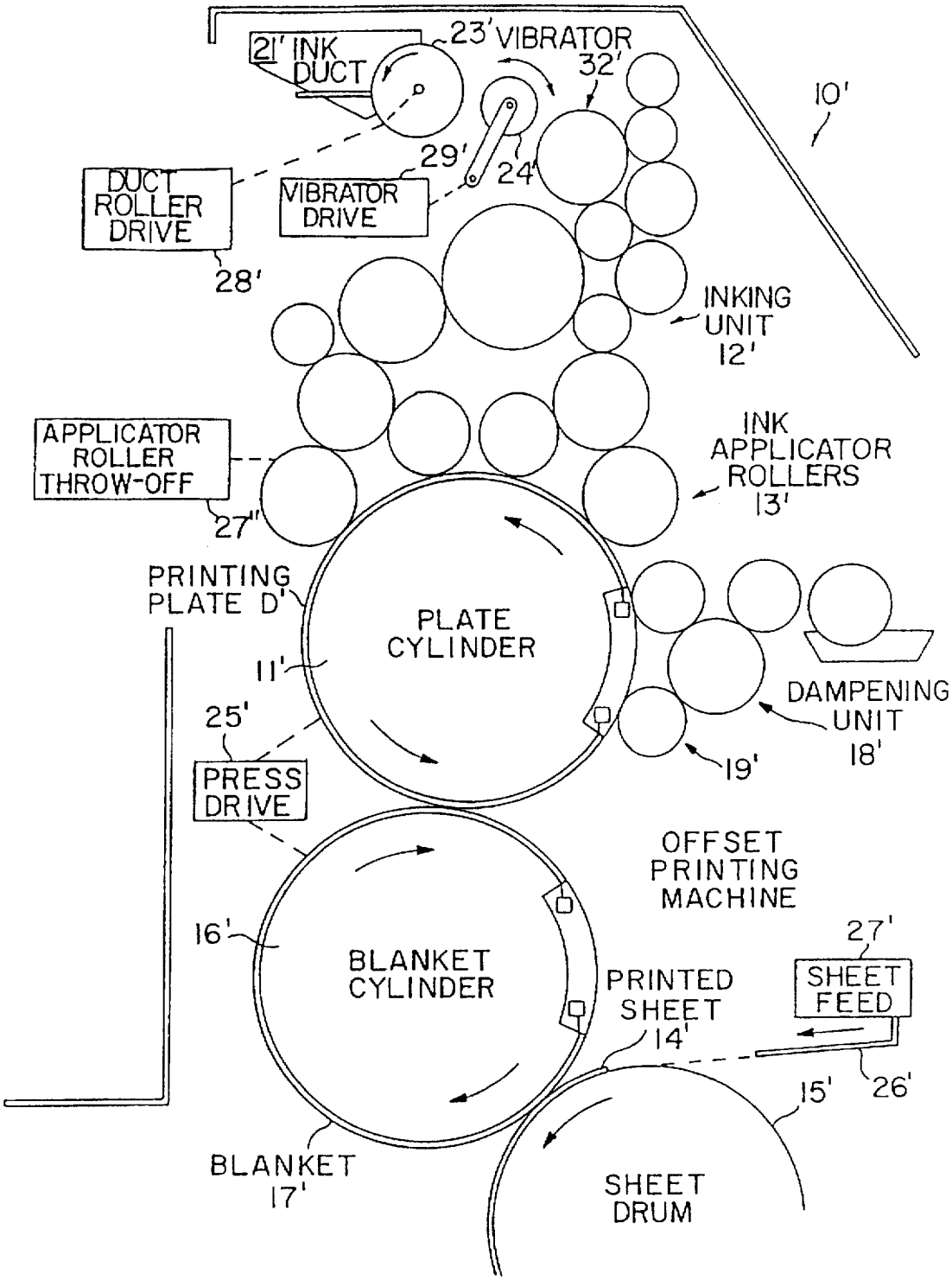
FIG. 1*c* illustrates a print stand of a rotary printing press in which the present invention may be employed.

FIG. 1*c* illustrates a rotary print stand 10' of a rotary printing press in which the present invention can be employed Rotary print stand 10' generally includes a plate cylinder 11' for having mounted thereon a printing plate D'; an inking unit 12' which includes ink applicator rollers 13' for applying ink to the printing plate an ink profile; a dampening (or wetting) unit 18' having dampening applicator rollers 19' for transferring a dampening agent to the printing plate, a blanket cylinder 16' carrying a rubber blanket 17' for receiving an ink impression from the printing plate, and a sheet drum 15' for carrying a printed sheet 14' onto which the ink impression carried by blanket 17' is transferred. A duct roller 23' is typically mounted adjacent to ink duct 21'. Typically, ink is transferred from duct roller 23' to inking unit 12' by means of a vibrator roller 24' which oscillates to successively pick up ink from duct roller 23' and deposit the same on a roller 32' of inking unit 10'. Typically, the printing stand 10' will also include auxiliary mechanisms such as, for example, a duct roller drive 28', a vibrator roller drive 29', an applicator roller throw-off 27" for lifting the ink applicator rollers 13' off of the printing plate, a press drive 25' and a sheet food 27, for supplying the sheets to be printed 26' to sheet drum 15'.

It should be understood that the components and methods discussed above with relation to FIG. 1*c* may, if appropriate, essentially be considered to be interchangeable with similar components and methods discussed further above with relation to FIG. 1*a* and herebelow with relation to FIGS. 1, 1*b*, 2 and 2*a*.

The disclosure now turns to a preferred embodiment of the present invention, as illustrated in FIGS. 1, 1*b*, 2 and 2*a*. Although one possible use of the arrangement shown in FIGS. 1, 1*b*, 2 and 2*a* is expressly disclosed herebelow with relation to upper portions of a print stand of a printing press, it should be understood that the arrangement described and illustrated with respect to FIGS. 1, 1*b*, 2 and 2*a* herebelow can be used in other contexts, such as in a lacquering, coating or varnishing unit of a printing press. In this respect, the fluid medium in question can be lacquer or varnish instead of ink. The general operation and makeup of such lacquering, coating or varnishing units will be well-known to those of ordinary *kill in the printing arts and, as, such, will not be described further herein. However, further details regarding such lacquering and drying stations can be found in the following two publications, both published by Beidelberger Druckmaschinen Aktiengesselschaft (Heidelberg, Germany), which are hereby incorporated by reference into the instant specification: "Lackieren und Trocknen", designated with the reference Heidelberger Nachrichten (EN) 3/49; and "Heidelberg M-Offset CP-Tronic", designated with the reference HN 1/49.

An ink fountain 1 having an ink-metering device 2 can typically contain a small ink reservoir 3. By means of the ink-metering device 2, an ink profile can be produced on a fountain roller 4, and the ink profile can then be transferred into an inking unit of a printing machine or printing pres.

A carriage 6 which executes a steady reciprocating motion over the length of the ink fountain 1 is preferably mounted on a traverse S secured between the machine side frames. In the carriage 6, a cap 10 is preferably urged onto a cartridge 11, via an arm 8 and a clamping screw 9, so that the cartridge, with its outlet nozzle 12, is preferably pressed, through the intermediary of a sealing means 13, onto a receptacle 14 of carriage 6. Via a compressed-air connection 15, the partition 16 of the cartridge 11 may be moved downwards by means of an adjustable pressure so that ink may leave through the outlet 17.

Preferably, as shown in FIG. 1*b*, compressed-air connection may be connected to a suitable compressed-air source 15*a*, examples of which will be well-known to those of ordinary skill in the art.

Thus, in accordance with at least one preferred embodiment of the invention, carriage 6, mounted on traverse 5, is preferably mounted in such a manner as to undergo an essentially constant oscillating or reciprocating motion in a direction parallel to the longitudinal direction of fountain roller 4, i.e. from the general vicinity of one machine side frame to the general vicinity of the other machine side frame, by means of a suitable drive device 7. The aforementioned sealing arrangements could conceivably include any of a wide variety of appropriate sealing media# which will likely be well-known to those of ordinary skill in the art. In accordance with at least one preferred embodiment of the invention, the aforementioned traverse 5 could conceivably be in the form of a simple beam-type structure extending across the printing press in question, between one press or machine side frame and the other. Receptacle 14 may preferably be embodied by a simple structural arrangement suitable for supporting cartridge 11.

Below the cartridge 11, the carriage 6 preferably features a pivoting bearing 18, and a lover 20 being fastened to a journal 19 of the pivoting bearing 18. The other, opposite end of the lover 20 is preferably supported on compression springs 21 with respect to both pivoting directions (see FIG. 2). Compression springs 21 are preferably guided on pins 22 and are preferably supported on abutments 23 attached to the carriage 6.

In the pivoting bearing 18, there is preferably mounted an ink-feeding pipe 24, and this pipe 24 is preferably swivellable about an angle (alpha) (see FIG.2) so that a respective compression spring 21 is compressed together, while the other spring 21 is relieved. The pivoting motion can essentially be initiated by the axial reciprocating motion of the carriage 6 and the stagnation pressure exerted by the ink reservoir 3 within the ink fountain 1 and acting on the lower end of the ink-feeding pipe 24.

Thus, in other words, in accordance with at least one preferred embodiment of the present invention, in a region below cartridge 11, carriage 6 can preferably include a pivoting bearing 18. Preferably extending outwardly from the pivoting bearing 18, and in a direction perpendicular to the direction of travel of carriage 6, is a journal 19 of pivoting bearing 18. A lever 20 is preferably fastened at one and of the lever 20, to this journal 19. Preferably, lever 20 extends essentially upwardly from this pivoting bearing 18 to a second locus of support for lever 20, at another and of the lover 20. This second locus of support is preferably provided at a connection arrangement 20*a*.

Preferably extending from connection arrangement 20*a*, in opposite directions from one another with respect to the direction of travel of carriages 6, are two pine or rods 22. Preferably disposed about each pin or rod 22 is a compression spring 21. Preferably, each compression spring is braced, on end thereof at the aforementioned connection arrangement 20*a*. Further, fixedly attached to, and extending from, carriage 6, are two abutments 23. One such abutment 23 preferably serves to brace one end of one of the compression springs 21, and the other abutment 23 preferably serves to brace on end of the other of the two compression springs 21. Thus, each compression spring 21 is preferably braced between a corresponding abutment 23 and the aforementioned connection arrangement 20*a*.

Preferably, in accordance with at least one preferred embodiment of the present invention, each pin or rod 22 will be slidably mounted with respect to its corresponding abutment 23 so that, for example, upon pivoting of lover 20, the pine 22 will slide through corresponding abutments 23 while the springs 21 are being extended or compressed.

Figure 2:
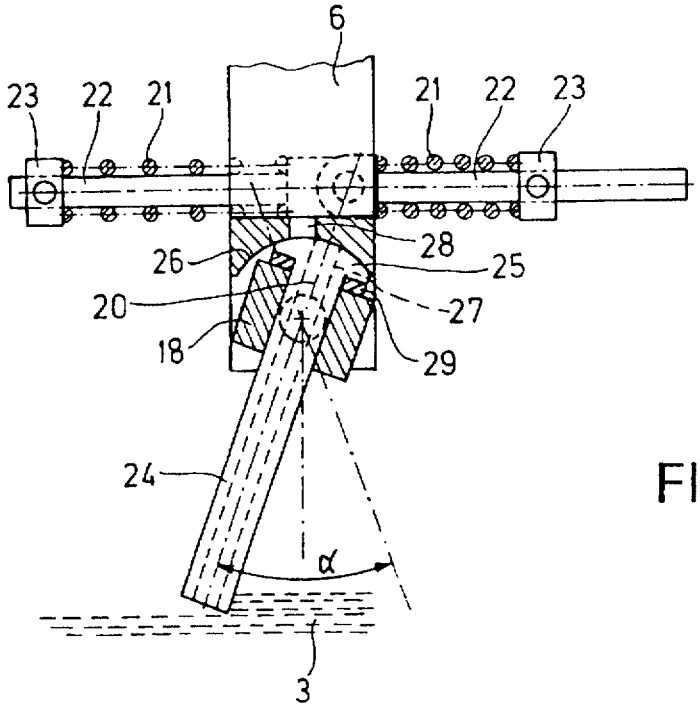
FIG. 2 is a fragmentary cross-sectional view of the ink-feeding p e mounted by means of a pivoting bearing.
Figure 2A:
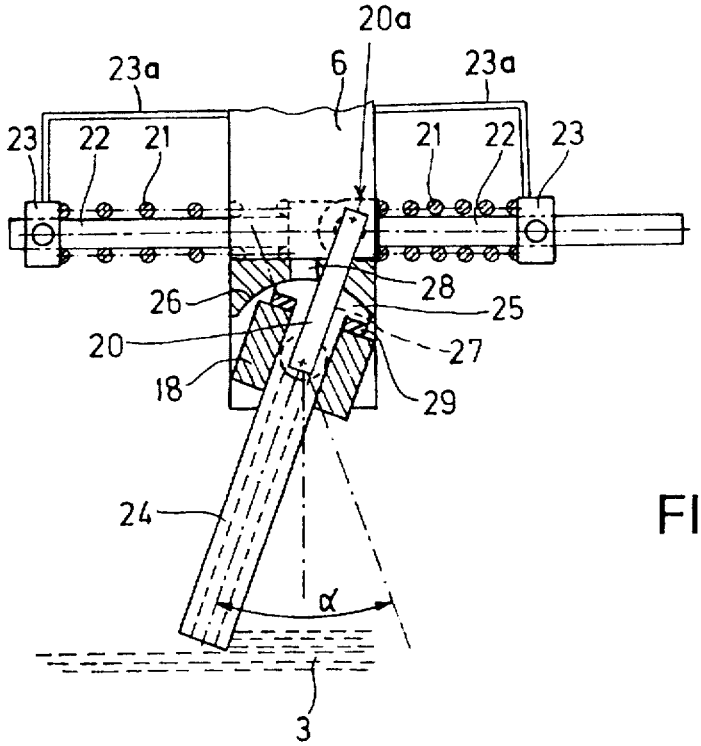
FIG. 2*a* is substantially the same view as FIG. 2, but more detailed.

As shown in FIG. 2*a*, a pair of support members 23*a* may preferably extend from carriage 6 in such a manner as to fixedly support abutments 23 with respect to carriage 6. Alternatively, if carriage 6 is of appropriate width, abutments 23 may extend directly from carriage 6 itself. Other possibilities for supporting abutments 23 with respect to carriage 6 are conceivable within the scope of the present invention and are not to be limited to the arrangements expressly described and/or illustrated herein.

It will be understood that, within the scope of the present invention, essentially any suitable type of connection arrangement may be used in conjunction with connection arrangement 20*a*. Preferably, such a connection arrangement 20*a* will be capable of pivotably mounting one end of lover 20, as discussed heretofore, as well as providing an appropriate locus of engagement for bracing an end of each of the compression springs 21 and supporting an and of each pin or rod 22. Further, each of the aforementioned abutments 23 can essentially be attached to carriage 6 in any suitable manner, but will preferably be fixedly attached to the same.

As mentioned heretofore, in accordance with at least one preferred embodiment of the present invention, an ink-feeding pipe 24 will preferably be pivotably mounted with respect to carriage 6, preferably by means of the aforementioned journal 19. Thus, preferably, both the ink-feeding pipe 24 and the lover 20 will be fixedly, i.e. non-rotatably, attached to the journal 19. Lever 20 and ink-feeding pipe 24 will then preferably be arranged with respect to journal 19 so that they may essentially pivot in tandem with respect to one another, i.e. simultaneously. In accordance with a preferred embodiment of the present invention, lever 20 and ink-feeding pipe 24 will preferably be oriented in a manner that is coplanar with respect to one another. This is best illustrated in FIG. 2*a*.

Preferably, ink-feeding pipe 24 will be pivotably in a range of angular displacement indicated by (alpha) in Figure 2. Essentially, this can be dictated by the compression strength of each compression spring 21.

In accordance with at least one preferred embodiment of the present invention, the pivoting motion of ink-feeding pipe 24 can be actuated by the axial reciprocating motion of the carriage 6 in conjunction with a force provided on the free or lower end of ink-feeding pipe 24 by what may be considered to be the "stagnation pressure" of the ink or ink reservoir 3 contained in ink fountain 1. In other words, when the ink 3 arrives at a sufficiently high level, a small portion of the free end of ink-feeding pipe 24 can essentially dip into the upper surface of the ink 3, whereupon, during axial reciprocating motion of carriage 6, the free and of ink-feeding pipe 24 will tend to remain in the ink 3, thus causing resistance to movement of pipe 24 in the reservoir. Then, if the resistance to any movement becomes greater than a force of a spring 21, ink-feeding pipe 24 along with lover 20, can be caused to pivot. Thus, the arrangement shown in FIG. 2 can be considered an illustrating what may occur when the level of ink 3 in the ink fountain 1 is sufficiently high, as discussed above, and when carriage 6 is moving, along with abutments 23, towards the right FIG. 2.

The upper and of the ink-feeding pipe 24 preferably features a sealing body 25 matching a circular sealing surface 26 provided on the carriage 6. By pivoting the ink-feeding pipe 24 to one side due to the filling height of the ink reservoir 3, as shown in FIG. 2, the feed opening 27 of the ink-feeding pipe 24 can essentially be moved into a position at the sealing surface 26 in which the food opening 27 would essentially not correspond to the feed opening 28 formed in the carriage 6. The outlet 17 of the cartridge 11 is preferably provided above the feed opening 28 so that, in this position, the ink feed to the ink fountain 1 is interrupted.

Thus, in accordance with a preferred embodiment of the present invention, when the ink 3 in the ink fountain is at a sufficiently high level, and the ink-feeding pipe 24 pivots as described above, the feed opening 27 of ink-feeding pipe 24 will essentially come out of alignment with feed opening 28 of carriage 6, thus preventing any through-flow of ink from feed opening 28 to feed opening 27. Preferably, the aforementioned sealing body 25 of ink-feeding pipe 24 will have a curved surface that preferably describes a portion of a circular arc during pivoting, and which is preferably compatible with a similar surface 26 on carriage 6. Preferably, the surface of sealing body 25 can be convex, while the sealing surface 26 of carriage 6 can be concave.

It should be understood that, in accordance with at least one preferred embodiment of the present invention, the compression strength or spring constants, of the compression springs 21 will preferably be configured so as to permit a pivoting motion of ink-feeding pipe 24, in the presence of a sufficiently high level of ink 3 in the ink fountain, to ensure that feed openings 27 and 28 will come out of alignment with one another. Conceivably, the compression strength or spring constant of the compression springs could take into account the likely viscosity of the ink 3. It is conceivable to configure the arrangement shown in FIG. 2 in such a manner that there ,could possibly be at least some overlap of the feed openings 27 and 28 with respect to one another, even in the presence of a sufficiently high level of ink 3 in the ink fountain, thus possibly still permitting at least a reduced flow of ink through ink-feeding pipe 24. It is also conceivable to permit easy removal of the compression springs 21, so as to be able to interchange the same with other compression springs having a different compression strength or spring constant. This could be done, for example, if it is desired to next utilize an ink 3 that has a markedly different viscosity from a previously used ink. Conceivably, the ultimate filling depth of reservoir 3 could also be adjusted by using springs with different compressions strengths or spring constants, for a single ink of a given viscosity. In other words, it is conceivable to, for example, provide a stronger pair of springs 21, for a given ink, if it is desired to fill reservoir 3 to a greater ultimate depth.

With the ink-feeding pipe 24 being in a perpendicular position, the outlet 17 and the feed openings 27, 28 can essentially coincide so that, due to the pressure of the compressed air supplied through the compressed-air connection 15, ink is conveyed into the ink fountain 1. In order to ensure a neat, taut or clean sealing between sealing body 25 and sealing surface 26, a sealing means 29 may be provided underneath the sealing body 25, such a sealing means 29 elastically supporting the sealing body 25 on the pivoting bearing 18. Due to the reciprocating motion of the carriage 6, the lower and of the ink-feeding pipe 24 can essentially stir the upper ink layer somewhat, which will essentially have a favorable effect on the ink. When changing inks, it is essentially only necessary to remove the cartridge 11, along with the cap 10, from the carriage 6 by untightening the clamping screw 9, followed by its replacement with a new cartridge 11.

Thus, in accordance with a preferred embodiment of the present invention, when the ink-feeding pipe 24 is perpendicular with respect to the surface of the ink 3, food openings 27 and 28 will preferably be fully aligned with respect to one another, in order to allow the provision of ink through openings 27 and 28 with the assistance of compressed air from compressed-air connection 15. A suitable sealing means or arrangement 29 can preferably be provided beneath sealing body 25, to ensure optimal sealing. Preferably, when carriage 6 undergoes reciprocating motion and when the level of ink 3 is sufficiently high so as to cause ink-feeding pipe 24 to pivot in the manner described heretofore, the ink-feeding pipe 24 can also essentially serve to stir the ink 3, at least at or near the surface of the ink reservoir 3, which can likely have a favorable effect on the ink. Thus, in accordance with at least one preferred embodiment of the present invention, the arrangement shown in FIG. 2 can essentially serve a dual function, that is, of simultaneously providing ink to ink reservoir 3 and stirring the ink in ink reservoir 3.

It should be understood that the term "reservoir" as set forth hereinabove can be construed as referring to the actual supply of ink within the ink fountain 1.

At impression throw off, essentially no printing ink may be necessary. In this case, one only has to switch off the compressed air supplied through the compressed-air connection 15 so that no further ink may got into the ink fountain 1.

One feature of the invention resides broadly in the device feeding printing ink to a rotary printing machine, said printing machine comprising an ink fountain provided with an ink-metering device for producing a certain ink film on a fountain roller, with the printing ink being taken from a cartridge and being distributed over the length of the ink fountain so that a carriage 6 with the cartridge is reciprocatingly guided at a traverse in longitudinal direction of the ink fountain, characterized in that, like a pendulum, an ink-feeding pipe 24 is mounted an said carriage 6 by means of a pivoting bearing 18, that in both pivoting directions said pivoting bearing 18 is supported, via a lever 20, on compression springs 21, that at the upper end of the ink-feeding pipe 24 there is provided a sealing body 25 matching a sealing surface 26 provided at the carriage 6, and that the lower end of the ink-feeding pipe 24 determines the height of the ink level in the ink fountain 1 so that, with said ink-feeding pipe 24 being in a perpendicular position, the feed opening 28 formed in said carriage 6 corresponds to the food opening 27 of said ink-feeding pipe 24, and printing ink is supplied; whereas the ink feed is interrupted, with said ink-feeding pipe 24 being in an oblique position.

In recapitulation, the present invention generally relates to a device feeding printing ink to a rotary printing press or machine, such a rotary printing press comprising an ink fountain provided with an ink-metering device for producing a given ink film on a fountain roller, with the printing ink being taken from a cartridge and being distributed over the length of the ink fountain so that a carriage is guided reciprocatingly, in longitudinal direction of the ink fountain, at a traverse.

A device such as that discussed above is disclosed in German Patent No. 23 24 462 C2 in which separate sensor means are provided to monitor the level of ink in the ink fountain. Electrical control means are provided to feed printing ink over a given period of time.

A device metering and feeding ink is also shown in German Patent No. 28 11 276 C2, in which a capacitive proximity switch is provided as a distance sensor monitoring the level of ink in the ink fountain. If necessary, a plunger, which may be advanced stepwise, feeds the metered quantity of ink. Here, too, an electrical monitoring device in provided to control the ink feed. with the known embodiments the electrical monitoring means may, however, can become sailed with printing ink, thereby causing malfunctions. In this respect, an appropriate ink feed cannot always be ensured.

Proceeding from the known arrangements discussed above, it is an object of the present invention to fill the ink fountain only with a small quantity of ink in a pressureless manner, and to distribute the ink uniformly over the length of the ink fountain.

According to at least one preferred embodiment of the present invention, the above object is achieved in that, like a pendulum, an ink-feeding pipe can be mounted on the carriage by means of a pivoting bearing. Via a lover, in both pivoting directions. The pivoting bearing can be supported on compression springs and at the upper and of the ink-feeding pipe, there can be disposed a sealing body which corresponds to a sealing surface provided on the carriage. The lower end of the ink-feeding pipe can determine the height of the ink level in the ink fountain so that, with the ink-feeding pipe being in a perpendicular position, the feed opening formed in the carriage coincides with the feed opening of the ink-feeding pipe such that printing ink is fed, whereas the ink feed can be interrupted when the ink-feeding pips is in an oblique position.

Given a low ink level, the ink fountain can be continuously filled with printing ink from the cartridge as a result of the reciprocating motion of the carriage with the ink-feeding pipe. If the ink level reaches a height at which the lower end of the ink-feeding pipe comes into contact with the ink, the ink can essentially urge the ink-feeding pipe to leave its perpendicular position due to the motion of the carriage, and the ink feed can be interrupted as a result of the pivoting motion. Depending on how far the lower end of the ink-feeding pipe reaches into the ink fountain, a very small quantity of ink, which may be removed very quickly when changing inks, can be maintained in the ink fountain at an essentially constant level. Due to the pressureless ink feeding and the uniform distribution of the ink, it may be ensured that the ink quantity conveyed by the fountain roller into the inking unit is accurately metered.

Examples of coating/lacquering/varnishing arrangements, and components associated therewith, which may be utilized in accordance with the embodiments of the present invention, may be found in the following U.S. Pat. Nos. 5,178,678, which issued to Koehler et al. on Jan. 12, 1993; No. 5,192,367, which issued to Rofmann on Mar. 9, 1993; No. 5,207,159, which issued to DeMoore et al. on May 4, 1993.

Examples of ink fountain arrangements, and components associated therewith, which may be utilized in accordance with the embodiments of the present invention, may be found in the following U.S. Pat. Nos. 5,280,750, which issued to Yoshida et al. on Jan. 25, 1994; No. 5,289,772, which issued to Kohara et al. on Mar. 1, 1994; and No. 5,303,649, which issued to Rader et al. on Apr. 19, 1994.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the U.S. patents recited herein, are hereby incorporated by reference as if set forth in their entirety herein.

The invention as described hereinabove in the context of the preferred embodiments is not to be taken as limited to all of the provided details thereof, since modifications and variations thereof may be made without departing from the spirit and scope of the invention.

List of Parts (FIGS. 1 and 2)

1 ink fountain
2 ink-metering device
3 ink reservoir
4 fountain roller
5 traverse
6 carriage
7 drive
8 arm
9 clamping screw
10 cap
11 cartridge
12 outlet nozzle
13 sealing means
14 receptacle
15 compressed-air connection
16 bottom
17 outlet
18 pivoting bearing
19 journal
20 lever
21 compression spring
2 pin
23 abutment
24 ink-feeding pipe
25 sealing body
26 sealing surface
27 feed opening
28 feed opening
29 sealing means

What is claimed is:

1. Device for feeding a fluid to a rotary printing press comprising:

apparatus for supplying a liquid;

said liquid supplying apparatus comprising:

a reservoir for holding a supply of liquid;

an arrangement for transferring liquid from said holding reservoir in said printing press;

an arrangement for delivering liquid to said holding reservoir;

a device for curtailing the supply of liquid to said holding reservoir from said delivering arrangement upon a predetermined volume of liquid being present in said holding reservoir;

said curtailing device comprising at least one portion having an arrangement for being mechanically altered upon the predetermined volume of liquid being present in said holding reservoir; and said arrangement for being mechanically altered being mechanically connected to said delivering arrangement, to curtail the supply of liquid to said holding reservoir from said delivering arrangement upon the predetermined volume of liquid being present in said holding reservoir;

a device for displaceably mounting said delivering arrangement with respect to said holding reservoir, said delivering arrangement being displaceable with respect to said holding reservoir to distribute liquid to portions of said holding reservoir;

said arrangement for being mechanically altered being stationary with respect to said delivering arrangement with the volume of liquid present in said holding reservoir being less than the predetermined volume and with said delivering arrangement being displaced with respect to said holding reservoir; and said arrangement for being mechanically altered being configured for being displaced with respect to said delivering arrangement upon the predetermined volume of liquid being present in said holding reservoir and with said delivering arrangement being displaced with respect to said holding reservoir.

2. The device according to claim 1, wherein said arrangement for being mechanically altered has a portion for being contacted by liquid held in said holding reservoir, upon the predetermined volume of liquid being present in said holding reservoir.

3.The device according to claim 2, wherein:

said arrangement for being mechanically altered comprises an arrangement for providing a pendulum motion;

said arrangement for providing a pendulum motion comprises pipe structure being pivotally mounted with respect to said delivering arrangement;

said pipe structure comprising a portion for being contacted by liquid, held in said holding reservoir, upon the predetermined volume of liquid being present in said holding reservoir;

said delivering arrangement comprises a channel arrangement for delivering liquid to said holding reservoir;

said pipe structure comprises additional channel arrangements disposed in said pipe structure, said additional channel arrangements being aligned with said channel arrangement with the volume of liquid present in said holding reservoir being less than the predetermined volume and with said delivering arrangement being displaced with respect to said holding reservoir, to permit through flow of liquid through said additional channel arrangement towards said holding reservoir; and said additional channel arrangement is at least partly out of alignment with said channel arrangement upon the predetermined volume of liquid being present in said holding reservoir and with said delivering arrangement being displaced with respect to said holding reservoir, to at least partially obstruct through flow of liquid through said additional channel arrangement to said holding reservoir.

4. The device according to claim 2, wherein:

said delivering arrangement comprises a channel arrangement for delivering liquid to said holding reservoir; and said arrangement for being mechanically altered comprises an arrangement for at least partially obstructing said channel arrangement upon the predetermined volume of liquid being present in said holding reservoir.

5. The device according to claim 4, wherein:

said arrangement for being mechanically altered comprises additional channel arrangements, said additional channel arrangements being aligned with said channel arrangement with the volume of liquid present in said holding reservoir being less than the predetermined volume and with said delivering arrangement being displaced with respect to said holding reservoir, to permit through flow of liquid through said additional channel arrangement towards said holding reservoir, the liquid comprises ink; and said additional channel arrangement is at least partly out of alignment with said channel arrangement upon the predetermined volume of liquid being present in said holding reservoir and with said delivering arrangement being displaced with respect to said holding reservoir, to at least partially obstruct through flow of liquid through said additional channel arrangement to said holding reservoir.

6. The device according to claim 5, wherein:

said arrangement for being mechanically altered comprises an arrangement for providing a pendulum motion;

said arrangement for providing a pendulum motion comprising a pipe structure being pivotally mounted with respect to said delivering arrangement;

said pipe structure having said portion for being contacted by liquid held in said holding reservoir, upon the predetermined volume of liquid being present in said holding reservoir;

said additional channel arrangement being disposed in said pipe structure;

said apparatus for supplying a liquid further comprises an arrangement for biasing said pipe structure into a rest position, wherein said channel arrangement and said additional channel arrangements are in alignment with one another, to permit through flow of liquid with the volume of liquid present in said holding reservoir being less than the predetermined volume; and said pipe structure for being displaced out of said rest position upon at least partial submersion of said portion for being contacted into liquid held in said holding reservoir, upon the predetermined volume of liquid being present in said holding reservoir, the at least partial submersion of said portion for being contacted being sufficient to counteract the biasing provided by said biasing arrangement.

7. The device according to claim 6, wherein:

said pipe structure is disposed substantially vertically in said rest position;

said pipe structure is disposed at an angle to the vertical when displaced out of said rest position, upon the predetermined volume of liquid being present in said holding reservoir.

8. The device according to claim 7, wherein:

said pipe structure has a first contact surface;

said delivering arrangement has a second contact surface; and said first and second contact surfaces being engaged with one another both with said pipe structure being in said rest position and with said pipe structure being displaced out of said rest position.

9. The device according to claim 8, wherein said first and second contact surfaces are configured to seal against one another while being engaged with one another, to prevent escape of liquid from said channel arrangement and said additional channel arrangements.

10. The device according to claim 8, wherein:

said holding reservoir comprises a fluid reservoir and roller arrangement for facilitating flow of fluid out of said fluid reservoir, said fluid reservoir having a longitudinal dimension defined parallel to a rotational axis of said roller arrangement;

said delivering arrangement comprises a carriage and an arrangement for displaceably mounting said carriage;

said carriage comprises an arrangement for interchangeably holding a cartridge of fluid;

said carriage being displaceable in a direction parallel to the longitudinal dimension of said fluid reservoir so as to uniformly distribute liquid along the longitudinal dimension of said fluid reservoir;

said device comprises a traverse for accommodating said arrangement for displaceably mounting said carriage;

said pipe structure comprises a pipe;

said pipe is mounted on said carriage, in the manner of a pendulum, by an arrangement of a pivoting bearing, said pivoting bearing comprising a rotatably mounted journal, said pipe being mounted to pivot about a pivot point defined at said journal;

said biasing arrangement comprises a pair of mutually opposing compression springs; said arrangement for being mechanically altered further comprises a lever extending from, and being fixed with respect to, said pivoting bearing;

said pair of mutually opposing compression springs being oriented to act on said lever and to bias said lever into said rest position of said pipe;

said delivering arrangement further comprises a pair of abutments extending from said carriage and being fixedly mounted with respect to said carriage;

each of said springs having a first end being braced against a corresponding one of said abutments;

said arrangement for being mechanically altered further comprises a connection arrangement;

said lever has a first end and a second end, said first end being fixedly mounted at said pivoting bearing, said second end being pivotally mounted at said connection arrangement;

each of said springs having a second end being braced against said connection arrangement;

said arrangement for being mechanically altered comprises a pair of rods extending from said connection arrangement, each of said springs being disposed about a corresponding rod;

each of said rods being slidably displaceable with respect to a corresponding one of said abutments;

said pipe structure comprises a sealing body disposed at an upper end of said pipe, said sealing body comprising said first contact surface;

said carriage comprising a receptacle region, said receptacle region comprising said second contact surface; and said first and second contact surfaces each describing matching partial circular arcs, the partial circular arcs having substantially equivalent radii defined with respect to said pivot point of said pipe.

11. A device for feeding a liquid in a rotary printing machine, said device comprising:

a reciprocatingly guided carriage;

a pivot disposed on said carriage;

a liquid-feeding pipe being mounted to swing like a pendulum in both pivoting directions from said carriage about said pivot;

valving for regulating flow through said liquid-feeding pipe;

said valving being in an open position upon said liquid-feeding pipe being in a vertical position;

said valving being in a closed position upon said liquid-feeding pipe being in a position oblique to the vertical position;

said liquid feeding pipe to be disposed to close said valving upon a predetermined volume of liquid being present in a liquid fountain and with said pipe being in an oblique position; and said liquid-feeding pipe disposed to open said valving upon less than a predetermined volume being present in a liquid fountain and with said pipe being in a vertical position.

12. A printing press comprising:

at least one printing unit comprising:

a frame;

a plate cylinder being rotatably mounted on said frame;

an inking unit for supplying ink to said plate cylinder;

a blanket cylinder having means for being engaged with said plate cylinder;

means for feeding sheets, to be printed, to said at least one printing unit;

means for directing printed sheets away from said at least one printing unit;

means for supplying a viscous liquid;

said liquid supplying means comprising:

means for holding a supply of viscous liquid;

means for transferring liquid from said holding means in said printing press;

means for delivering liquid to said holding means;

means for curtailing the supply of liquid to said holding means from said delivering means upon a predetermined volume of liquid being present in said holding means;

said curtailing means comprising at least one portion having means for being mechanically altered upon the predetermined volume of liquid being present in said holding means; and said means for being mechanically altered being mechanically connected to said delivering means, to curtail the supply of liquid to said holding means from said delivering means upon the predetermined volume of liquid being present in said holding means;

means for displaceably mounting said delivering means with respect to said holding means, said delivering means being displaceable with respect to said holding means to distribute liquid to portions of said holding means;

said means for being mechanically altered being stationary with respect to said delivering means with the volume of liquid present in said holding means being less than the predetermined volume and with said delivering means being displaced with respect to said holding means; and said means for being mechanically altered being configured for being displaced with respect to said delivering means upon the predetermined volume of liquid being present in said holding means and with said delivering means being displaced with respect to said holding means.

13. The printing press according to claim 12, wherein:

said means for being mechanically altered comprises means for providing a pendulum motion;

said means for providing a pendulum motion comprises pipe means being pivotally mounted with respect to said delivering means;

said pipe means comprising a portion for being contacted by liquid, held in said holding means, upon the predetermined volume of liquid being present in said holding means;

said delivering means comprises channel means for delivering liquid to said holding means;

said pipe means comprises additional channel means disposed in said pipe means, said additional channel means being aligned with said channel means with the volume of liquid present in said holding means being less than the predetermined volume and with said delivering means being displaced with respect to said holding means, to permit through flow of liquid through said additional channel means towards said holding means; and said additional channel means is at least partly out of alignment with said channel means upon the predetermined volume of liquid being present in said holding means and with said delivering means being displaced with respect to said holding means, to at least partially obstruct through flow of liquid through said additional channel means to said holding means.

14. The printing press according to claim 12, wherein said means for being mechanically altered has a portion for being contacted by liquid held in said holding means, upon the predetermined volume of liquid being present in said holding means.

15. The printing press according to claim 14, wherein:

said delivering means comprises channel means for delivering liquid to said holding means; and said means for being mechanically altered comprises means for at least partially obstructing said channel means upon the predetermined volume of liquid being present in said holding means.

16. The printing press according to claim 15, wherein:

said means for being mechanically altered comprises additional channel means, said additional channel means being aligned with said channel means with the volume of liquid present in said holding means being less than the predetermined volume and with said delivering means being displaced with respect to said holding means, to permit through flow of liquid through said additional channel means towards said holding means; and said additional channel means is at least partly out of alignment with said channel means upon the predetermined volume of liquid being present in said holding means and with said delivering means being displaced with respect to said holding means, to at least partially obstruct through flow of liquid through said additional channel means to said holding means.

17. The printing press according to claim 16, wherein:

said means for being mechanically altered comprises means for providing a pendulum motion;

said means for providing a pendulum motion comprising pipe means being pivotally mounted with respect to said delivering means;

said pipe means having said portion for being contacted by liquid held in said holding means, upon the predetermined volume of liquid being present in said holding means;

said additional channel means being disposed in said pipe means;

said supplying means further comprises means for biasing said pipe means into a rest position, wherein said channel means and said additional channel means are in alignment with one another, to permit through flow of liquid with the volume of liquid present in said holding means being less than the predetermined volume; and said pipe means for being displaced out of said rest position upon at least partial submersion of said portion for being contacted into liquid held in said holding means, upon the predetermined volume of liquid being present in said holding means, the at least partial submersion of said portion for being contacted being sufficient to counteract the biasing provided by said biasing means.

18. The printing press according to claim 17, wherein:

said pipe means is disposed substantially vertically in said rest position;

said pipe means is disposed at an angle to the vertical when displaced out of said rest position, upon the predetermined volume of liquid being present in said holding means.

19. The printing press according to claim 18, wherein:

said pipe means has a first contact surface;

said delivering means has a second contact surface;

said first and second contact surfaces being engaged with one another both with said pipe means being in said rest position and with said pipe means being displaced out of said rest position.

20. The printing press according to claim 19, wherein said first and second contact surfaces are configured to seal against one another while being engaged with one another, to prevent escape of liquid from said channel means and said additional channel means, and wherein:

said holding means comprises a fluid reservoir and roller means for facilitating flow of fluid out of said fluid reservoir, said fluid reservoir having a longitudinal dimension defined parallel to a rotational axis of said roller means;

said delivering means comprises a carriage and means for displaceably mounting said carriage;

said carriage comprises means for interchangeably holding a cartridge of fluid;

said carriage being displaceable in a direction parallel to the longitudinal dimension of said fluid reservoir so as to uniformly distribute liquid along the longitudinal dimension of said fluid reservoir;

said printing press comprises a traverse for accommodating said means for displaceably mounting said carriage;

said pipe means comprises a pipe;

said pipe is mounted on said carriage, in the manner of a pendulum, by means of a pivoting bearing, said pivoting bearing comprising a rotatably mounted journal, said pipe being mounted to pivot about a pivot point defined at said journal;

said biasing means comprises a pair of mutually opposing compression springs;

said means for being mechanically altered further comprises a lever extending from, and being fixed with respect to, said pivoting bearing;

said pair of mutually opposing compression springs being oriented to act on said lever and to bias said lever into said rest position of said pipe;

said delivering means further comprises a pair of abutments extending from said carriage and being fixedly mounted with respect to said carriage;

each of said springs having a first end being braced against a corresponding one of said abutments;

said means for being mechanically altered further comprises a connection arrangement;

said lever has a first end and a second end, said first end being fixedly mounted at said pivoting bearing, said second end being pivotally mounted at said connection arrangement;

each of said springs having a second end being braced against said connection arrangement;

said means for being mechanically altered comprises a pair of rods extending from said connection arrangement, each of said springs being disposed about a corresponding rod;

each of said rods being slidably displaceable with respect to a corresponding one of said abutments;

said pipe means comprises a sealing body disposed at an upper end of said pipe, said sealing body comprising said first contact surface;

said carriage comprising a receptacle region, said receptacle region comprising said second contact surface; and said first and second contact surfaces each describing matching partial circular arcs, the partial circular arcs having substantially equivalent radii defined with respect to said pivot point of said pipe.

* * * * *